United States Patent [19]

Dake

[11] 3,981,112

[45] Sept. 21, 1976

[54] PREFABRICATED STAIR CONSTRUCTION

[76] Inventor: Norman W. Dake, 1756 E. Ave. NE., Cedar Rapids, Iowa 52406

[22] Filed: Dec. 6, 1974

[21] Appl. No.: 530,078

[52] U.S. Cl. ..... 52/184; 52/189

[51] Int. Cl.[2] ..... E04F 11/00; E04F 11/18

[58] Field of Search ..... 52/184–191

[56] References Cited

UNITED STATES PATENTS

| | | | |
|---|---|---|---|
| 1,861,751 | 6/1932 | Nicols | 52/189 |
| 1,870,598 | 8/1932 | Amann | 52/184 |
| 2,703,005 | 3/1955 | Dobermann | 52/189 |
| 3,672,106 | 6/1972 | Mulitz | 52/189 |
| 3,875,708 | 4/1975 | Thorsnes | 52/189 |

FOREIGN PATENTS OR APPLICATIONS

| | | | |
|---|---|---|---|
| 1,119,467 | 4/1956 | France | 52/184 |

*Primary Examiner*—J. Karl Bell

[57] ABSTRACT

A prefabricated stair construction consisting of a pair of spaced, parallel stair stringers, either one or both being a free span member between support beams with developed strength of a rigid truss by the joining of stair rails, balusters and stringer into a single unit. The stringers are joined together by a plurality of precast treads secured at each end to the stringer by two welded flanges, the treads having a reinforced nose portion and riser to decrease the bending moment of the tread.

5 Claims, 5 Drawing Figures

FIG. 1
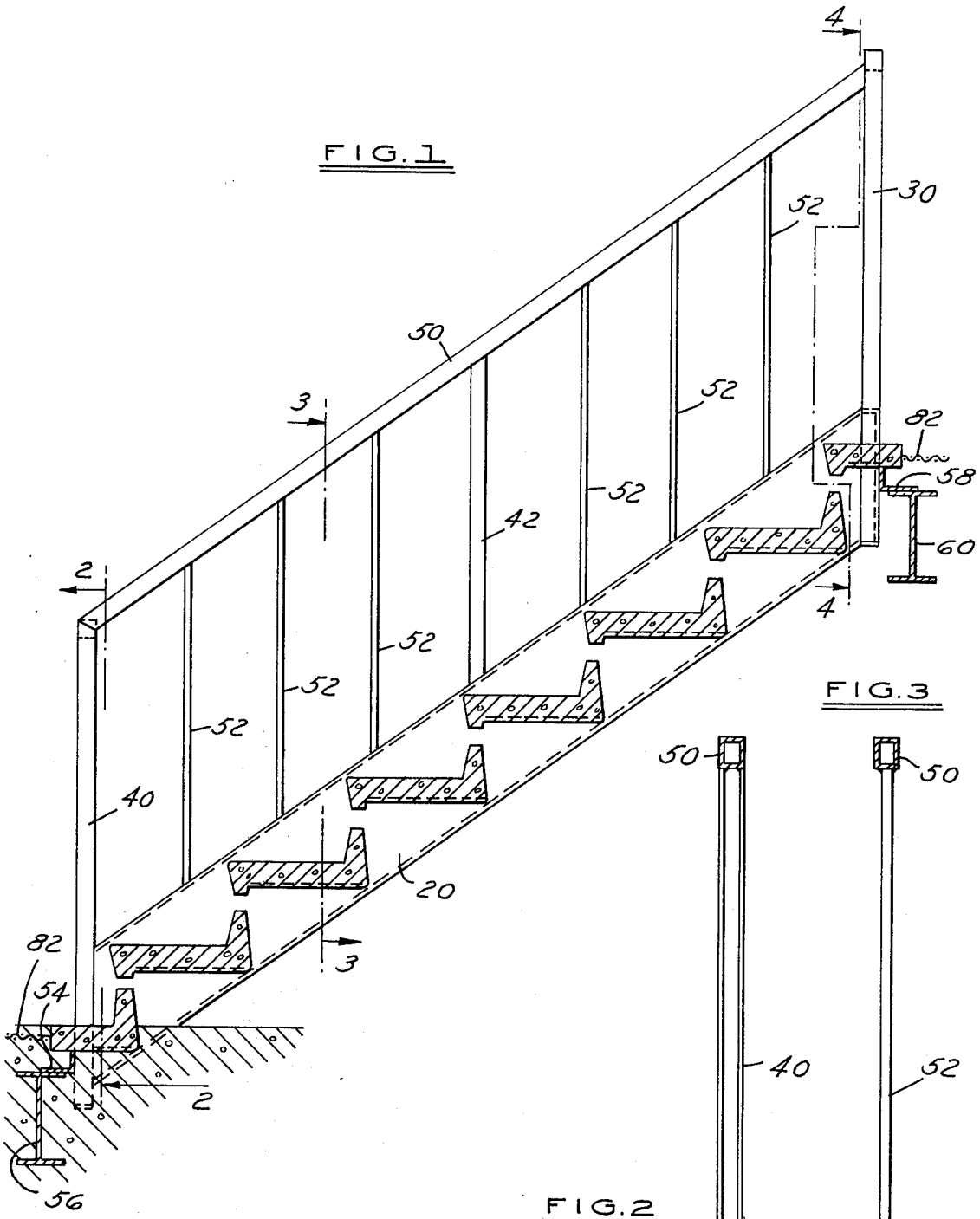
FIG. 3
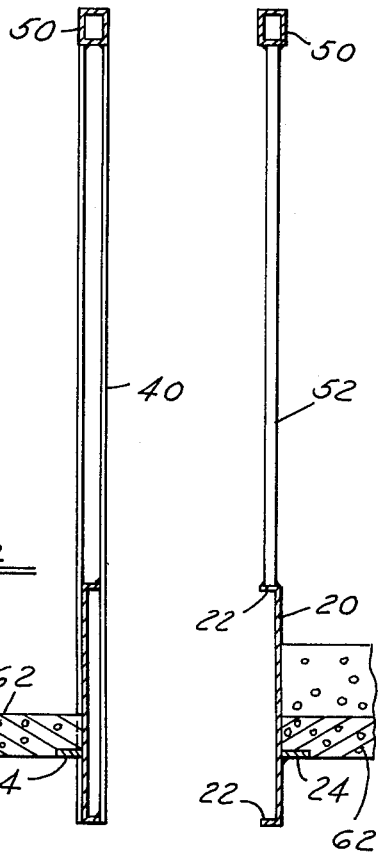
FIG. 2

PREFABRICATED STAIR CONSTRUCTION

This invention relates to a Prefabricated Stair Construction and more particularly to a stair assembly which can be prepared off-site and installed on-site of building structures such as apartments, office buildings, manufacturing plants and the like.

The following United States patents are illustrative of the art of prefabricated stair construction:

| | | |
|---|---|---|
| 2,721,472 | Oct. 25, 1955 | McAver |
| 2,907,402 | Oct. 6, 1959 | Lewis |
| 3,707,814 | Jan. 2, 1973 | Seegers |

It is an object of the present invention to provide a stair construction which can be adapted to prefabrication and readily installed at a building site with a minimum of cutting and welding.

It is a further object to provide a construction which includes the stair railing as a part of the structure, thus adding strength to the railing while reinforcing the stringer thus permitting lighter members to be utilized.

Another object of the invention is the design of a stair construction which is essentially closed and clean in all respects so that plastering and covering are unnecessary, the bottom exposure being neat and attractive.

A still further object of the invention is a design in which the ends of the beam lengths are closed by rail posts to avoid unsightly projections while providing flat weld areas for landing channel and support angles.

An additional object of the invention is the incorporation of precast treads into the truss construction to form the complete structural assembly and to facilitate the tie-in with the on-site structure.

Other objects and features of the invention relating to details of construction and operation will be apparent in the following description and claims in which the principles of the invention are set forth in connection with a disclosure of the best mode presently contemplated for the practice of the invention.

DRAWINGS accompany the disclosure and the various view thereof may be briefly described as:

FIG. 1, a side view, partially in section, showing the assembled stair construction.

FIG. 2, a sectional view on line 2—2 of FIG. 1.

FIG. 3, a sectional view on line 3—3 of FIG. 1.

Figure 4:
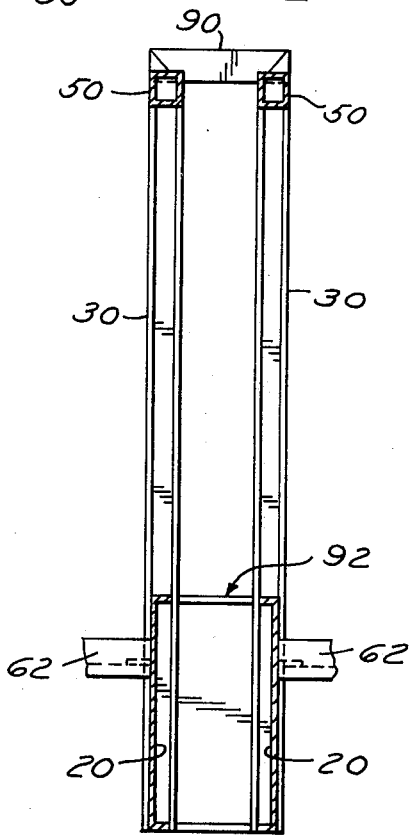

FIG. 4, a sectional view on line 4—4 of FIG. 1.

Figure 5:
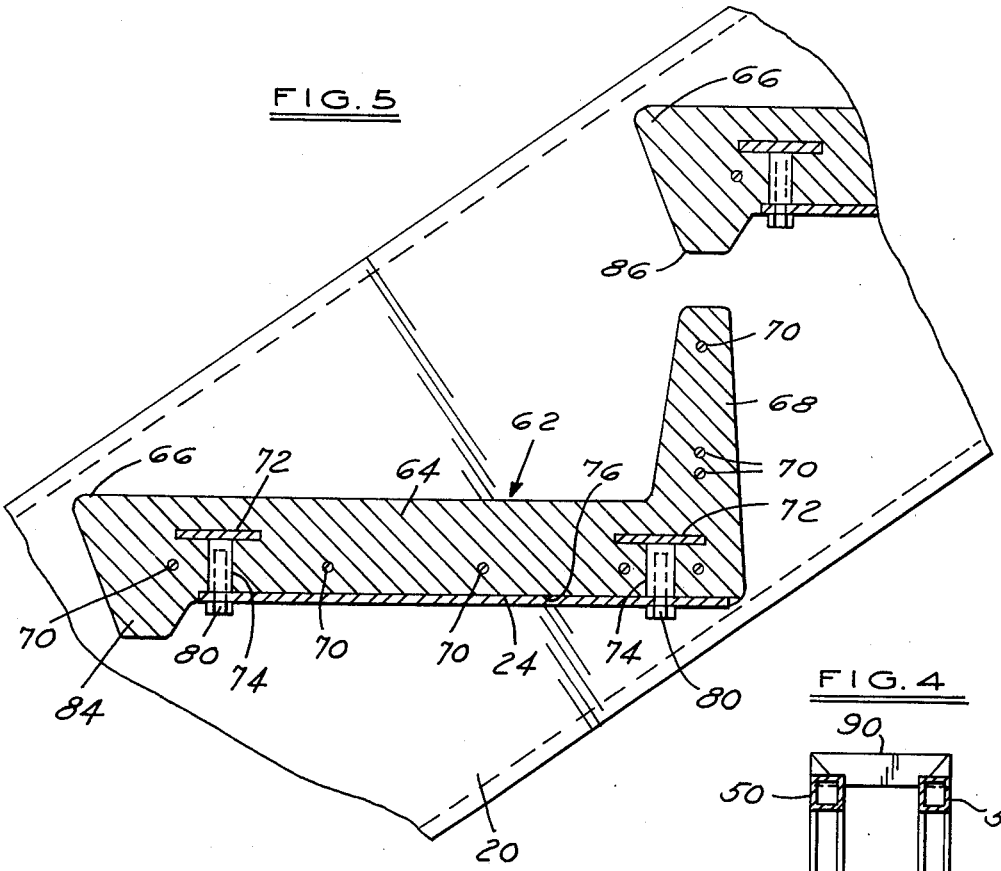

FIG. 5, an enlarged section of the stair tread assembly showing details of construction.

In the drawings:

In FIG. 1, the free span stringer 20 between in situ support beams is shown, the flange portions 22 of the stringer facing to the outside of the assembly. An opposite hand stringer, with or without railing attached, is located parallel to stringer 20. Each stringer has a series of shelf plates 24 mounted horizontally thereon at spaced intervals along the channel to correspond with the intended angle of the stair assembly. At each end of the free span stringer channel is a post. At the top end there is a post 30 and at the lower end there is a post 40. These posts have a square construction and a horizontal dimension which extends over the channel wall and the channel flanges.

Essentially then, when the post is welded to the end of the channel, it closes the end of the channel. A third post 42 rises from the top surface of the stringer channel and the top of the posts are connected by a balustrade rail 50. All of these parts are welded together. Between the vertical posts are balusters 52, each of which is welded at each end to the stringer channel and to the balustrade rail.

Thus, it will be seen that a structural truss is formed in the assembly of the stringer channel, the posts 30, 40 and 42, the balustrade rail 50, and the balusters 52. At the bottom of the unit is an angle member 54 welded to post 40 which will be field welded to an I-beam 56. Similarly, at the top, an angle element 58 is welded to post 30 and landing channel 92 and will be field welded to a structural I-beam member 60.

The tread elements 62 of the unit are shown in sectional view in FIG. 5 consisting of a central tread portion 64, a nose portion 66, and a riser portion 68. The treads are cast of a suitable agglomerate such as concrete which sets up into a rigid and strong element. They are provided with reinforcing rods 70 throughout the various areas extending lengthwise of the tread. At each end of the tread there is embedded hollow, internally threaded socket elements 74 having a plate base and which extend to the bottom surface of the tread. The tread is provided with a recess 76 at each end directly below these reinforcing elements to receive the shelf plates 24. Thus, the end of the treads will abut flush against the wall of the stringer channel, the shelf plates will be received in the shallow recess 76, and then hexagonally headed bolts 80 can be screwed through the shelf plate into the sockets 74 to secure the treads on and against the stringer channels. The bottom and top treads of the assembly are partially formed and provided with a wire mesh extension 82 which will be embedded in the concrete floor which is cast above the supporting I-beams 56 and 60 and which forms the platforms at the top and bottom of the stairs.

It will be seen that the hosing of the tread is thickened with a drop portion 84 which provides additional strength to withstand deflection. Similarly, at the rear end of the tread, there is a riser portion which is reinforced with the rods 70 and this also gives added strength to the tread. The nosing of the tread is extended beyond the riser line passing vertically through the joint 86, and the counterweighted riser 68 is located behind the riser line so that weight exerted on the tread surface will be compensated for to some degree by the weight of the riser, thus reducing tendency to "rock" and similarly the rear bolt 74 will have the greatest fulcrum to resist this tendency to rock.

It will be seen that in this assembly, with the shelf plates recessed into the lower end surfaces of the treads, there will be a very clean underview of the stair, thus avoiding the necessity for plastering or spray coating. The space between the top of the riser 68 and the bottom of the nose 66 gives a certain amount of flexibility in determining the amount of rise desired in any particular stair.

The present design has distinct advantages in transition at the platforms in that the balustrade rail 50 can be extended to the next adjacent rail by a short transition hand-hold rail 90 as shown in FIG. 4. The terminal post may be mitered at 45° so that the hand-hold rail can be easily field welded to give a continuous hand-hold as a person is going up or down the stairs. Similarly, a transition channel element 92 can be used as shown in FIG. 4 at the base of the end posts 30 and this channel will weld neatly between these posts and again present a closed appearance.

It will be seen that the length of the hand-hold rail 90 and the channel 92 can be readily varied to meet the specifications of the various buildings in which the preformed units are being installed.

When the stair units with the two structural units on each side are assembled with the treads, there is a very strong truss bridge formed wherein the balustrade rail and the end posts, as well as the balusters, provide an engineering structural truss so that the portion of the stair which has generally been referred to as the railing is actually now a portion of the weight bearing unit. This permits smaller and lighter stringer channels which adds to the neatness of the appearance of the final assembly. In addition, as pointed out, the posts cooperate with the channels to provide a closed appearance when the assembly is completed.

I claim:

1. A prefabricated structure for a stair assembly which comprises:

a. a steel beam stringer channel disposed with the flanges of the channel extending to one side which is the outside in assembly, b. a rail post rigidly secured at each end of the stringer channel positioned at an acute angle to the stringers wherein to be disposed in an upward vertical direction in final assembly and having a dimension transverse of the stair construction to close the flange area at the ends of the stringer channel, c. a balustrade rail rigidly secured to the top ends of said rail posts to form a load bearing parallelogram structure with said stringers, d. a plurality of balusters rigidly secured to a top flange of the stringer channel and to the balustrade rail to rigidify the said parallelogram structure into a structural truss, and e. a plurality of short, tread-supporting shelves affixed in parallel spaced relation on the other side of said stringer which is the inside in assembly to support the ends of a plurality of preformed treads.

2. A prefabricated stair construction which comprises:

a. a pair of spaced, parallel *steel beam* stringer channels having flanges extending outwardly, b. a plurality of pairs of opposed tread supporting flanges on the inside of said channels, secured between said channels in spaced and stepped parallel relation and disposed at a predetermined angle to the stringer channels for supporting preformed treads, c. a rail post rigidly secured at each end of each stringer channel in an acute angle relationship positioned perpendicular to the plane of the treads and having a dimension transverse of the stair construction to close the flange area of the stringer channel, d. a balustrade rail rigidly secured to the top ends of said rail posts to form a load bearing parallelogram structure with said stringers, e. a plurality of balusters rigidly secured to a top flange of a stringer channel and to the respective balustrade rail over each stringer to rigidify the said parallelogram structure into a structural truss, and f. a plurality of independent, preformed treads each removably secured at each end to one of a pair of opposed tread supporting flanges in vertical spaced relation to each other to complete a stair structure.

3. A prefabricated stair construction as defined in claim 2 in which the tread is a precast aggregate having a nose portion, tread portion, and a riser portion, the end of which is closely fitted against the wall of the stringer, and means removably interengaging said tread supporting flanges and said treads.

4. A prefabricated stair construction as defined in claim 3 in which the riser at the rear of the tread is provided with a reinforced heel portion to act as a weight at the rear of the tread to counterbalance weight carried by the tread portion.

5. A tread unit as defined in claim 3 in which the bottom surface of the tread unit lies in a plane and flat surface and the ends of the bottom surface are recessed to provide an elongate groove below the metal sockets transverse to the length of the tread to receive a support flange to be secured to the treads.

* * * * *